United States Patent [19]

McIntyre et al.

[11] Patent Number: 4,496,437

[45] Date of Patent: Jan. 29, 1985

[54] METHOD FOR PRODUCING A DUAL POROSITY BODY

[75] Inventors: James A. McIntyre; Robert F. Phillips, both of Midland, Mich.

[73] Assignee: The Dow Chemical Company, Midland, Mich.

[21] Appl. No.: 506,912

[22] Filed: Jun. 22, 1983

[51] Int. Cl.[3] ..... C25D 7/04

[52] U.S. Cl. ..... 204/24; 204/26

[58] Field of Search ..... 204/24, 26, 11, 242

[56] References Cited

U.S. PATENT DOCUMENTS

| | | | |
|---|---|---|---|
| 3,480,530 | 11/1969 | Voorhies | 204/129.7 |
| 3,798,136 | 3/1974 | Olsen | 204/26 |
| 4,045,303 | 8/1977 | Campbell | 204/24 |
| 4,053,371 | 10/1977 | Towsley | 204/26 |
| 4,204,918 | 5/1980 | McIntyre | 204/24 |
| 4,326,930 | 4/1982 | Nagel | 204/24 |

*Primary Examiner*—Thomas Tufariello

*Attorney, Agent, or Firm*—J. H. Dickerson

[57] ABSTRACT

The invention includes within its scope a method for producing a dual porosity body from a substrate having a plurality of passageways traversing the substrate and connecting a first surface with a generally opposing second surface by depositing a solid material onto the walls of at least a portion of the passageways adjoining only the first surface and stopping the deposition when the diameter of the passageways being coated have been reduced to a predetermined value.

14 Claims, No Drawings

METHOD FOR PRODUCING A DUAL POROSITY BODY

BACKGROUND OF THE INVENTION

This invention concerns a method for producing a dual porosity body and specifically a method for producing a dual porosity gas electrode by depositing a solid material onto only a portion of the walls of a substrate which has a plurality of interconnected passageways traversing the substrate.

Electrodes suitable for electrochemically reacting a gas with a liquid and having a plurality of interconnected passageways traversing the electrode member are well known in the art. Single porosity electrodes are those in which the diameter of the passageways traversing the member do not vary to a substantial degree. Dual porosity electrodes are known in the art and are described in, for example, U.S. Pat. Nos. 4,341,606 and 4,260,469. Dual porosity electrodes are comprised of two, interconnected, porous layers having passageways which differ in diameter from each other. For electrochemical processes, the passageways in a coarse layer usually have diameters of from about 6 to about 12 microns, while the passageways of a fine layer usually have diameters of from about 0.1 to about 5 microns.

Dual porosity electrodes may be prepared in a variety of ways. Commonly, the coarse and fine layers are prepared separately by bonding or sintering together a plurality of particles. The individual layers are then bonded or sintered to each other. An optional preparation method involves forming one layer by bonding or sintering a plurality of particles together, followed by depositing a slurry of metal powder onto the prepared layer and sintering the layers together. However, in any of these preparation methods, sintering conditions (time and temperature) must be carefully controlled to prevent excessive deformation of the individual layers.

A convenient method to prepare dual porosity electrodes without the problems discussed above would be highly useful. The present invention provides such a method.

SUMMARY OF THE INVENTION

The invention includes within its scope a method for producing a dual porosity body from a substrate having a plurality of passageways traversing the member and connecting a first surface with a generally opposing second surface by depositing a solid material onto the walls of at least a portion of the passageways adjoining only the first surface and stopping the deposition when the diameter of the passageways being coated have been reduced to a predetermined value.

DETAILED DESCRIPTION OF THE INVENTION

Substrates suitable for use in the present invention are those having a plurality of passageways traversing the substrate and connecting at least two generally opposing surfaces of the substrate. The original diameter of the passageways is not critical to the operability of the present invention. However, when such coated substrates are to be used as gas electrodes, beginning passageway diameters of from about 5 to about 12 microns are commonly used.

Likewise, the physical dimensions of the substrate are not critical to the operability of the invention. The length and width, or diameter, of the substrate is usually dependent upon the use to which the coated substrate will be put. The thickness of the substrate, also, is not critical to the operability of the invention. However, when the coated substrates are to be used as gas electrodes, thicknesses of from about 1 to about 3 millimeters are commonly used.

Substrates suitable for use in the present invention are commercially available, or they may be easily prepared by bonding or sintering together a plurality of individual particles. The sintering time and temperature depend upon the composition of the particles. Such parameters may be easily determined for any particular type of material through references or through routine experimentation.

The coated substrates must be electrically conductive to be suitable for use as electrodes. They may be constructed from an electrically conductive substrate or constructed from an electrically nonconductive substrate coated with an electrically conductive material. Particularly suitable materials are metals such as steel, iron, nickel, copper, mixtures thereof and alloys thereof.

To convert a single porosity substrate to a dual porosity body, at least a portion of one surface of the single porosity substrate is subjected to the deposition of a coating material. The material should be deposited in a manner to coat at least a portion of the walls of those passageways adjoining only the first surface, thus reducing their diameter. The depth of penetration of the coating material into the passageways of the substrate depends upon the diameter of the passageways and the method of deposition. However, to be useful as a dual porosity gas electrode, penetration depths may be as small as about 0.025 millimeter to as large as about 2.0 mm.

Materials which are suitable for deposition onto the passageway walls as described herein, may be selected from a wide variety of materials including metals, metal alloys, ceramics and inorganic solids. When the coated body is to be used as an electrode, preferably the coating material is electrically conductive. Particularly suitable are metals and metal alloys. The coating material may be an electrocatalyst, for example, one active for the conversion of an alkali metal halide into a halogen and an alkali metal hydroxide.

Suitable deposition methods include electroplating, electroless plating, flame spraying, arc spraying, plasma spraying, electrostatic powder coating, slurry coating, chemical vapor deposition, vacuum deposition and sputtering. Such methods are well-known to those skilled in the art and are discussed in the Kirk-Othmer Encyclopedia of Chemical Technology, 3rd Edition, Volume 15, pages 253–274. These teachings are hereby incorporated by reference.

A particularly preferred method for depositing the material is by electrodeposition. A wide variety of electrodeposition solutions are suitable for use in the present invention. The solutions may contain a metal which is the same as the metal from which the substrate is constructed, or it may contain a different metal. Suitable electrodepositable metals include but are not limited to such things as iron, nickel, copper, alloys thereof or mixtures thereof. Conveniently, the deposited metal may be an electrocatalyst. For example, when the coated body is to be used as a gas electrode in a chlor-alkali electrolytic cell the electrodeposited metal may conveniently be materials which are catalysts for the electrolysis of alkali metal halides, such catalysts include Pt, Ag, Ni or Au.

Methods and guidelines for the selection of suitable solutions are described in, for example, "Modern Electroplating", F. A. Lowenham, Ed., John Wiley and Sons, New York, 1974 and Kirk-Othmer Encyclopedia of Chemical Technology Third Edition, Volume 15, pages 253–267, John wiley & Sons, New York, 1978, the teachings of which are hereby incorporated by reference.

During electrodeposition, it is necessary to maintain the substrate in a position such that the electrodeposition solution contacts only a portion of the substrate.

One convenient means for limiting the degree of penetration of the electrodeposition solution into the passageways of the substrate is by applying a gas, under a controlled pressure, to a side of the substrate not contacting the electrodeposition solution. The so-applied gas permeates through at least a portion of the passageways of the substrate while the electrodeposition solution contacts another face of the substrate and enters the passageways, because of its hydraulic pressure. At the point where the hydraulic pressure of the electrodeposition solution corresponds to the pressure of the gas, an equilibrium is reached and the solution does not permeate further. The gas pressure and the hydraulic pressure of the electrolyte may be adjusted and balanced to easily provide the desired depth of penetration of the solution into the substrate.

An equally acceptable, and optional, method limiting the depth of penetration of the electrodeposition solution is by only partially submerging the substrate into the solution during electrodeposition.

The size of the passageways before, during, or after electrodeposition may be easily and quickly determined using the following equation:

$$r = \frac{(-2\gamma \cos \theta)(9.87 \times 10^{-7})}{P}$$

where:

r = passageway radius, microns;

$\gamma$ = surface tension, dynes/cm;

$\theta$ = contact angle, degrees;

P = capillary pressure, atmospheres.

To determine the radius of the passageways, the article is at least partially submerged in a liquid of a known surface tension ($\gamma$). A gas under pressure is then applied to a surface of the article not in contact with the liquid. The gas pressure is slowly increased until bubbles are observed coming from the article. This is the capillary pressure of the article (P). The contact angle ($\theta$) is assumed to be zero when the body is fully wetted.

Note that this procedure gives the radius of the largest passageways in the coated portion of the article. However, in practice, the coated portion of the article will have a range of pore sizes. Thus the above procedure serves as a quick method to determine the approximate size of the passageways. More accurate methods of determining passageway size are available and known, but are more time consuming. However, more accurate methods may conveniently be used.

The diameter of the passageways after deposition is a matter of choice, depending upon the use to which the coated substrate will be put. For use as a gas electrode in a chlor-alkali cell, it has been determined that deposition should be continued until the surfaces of the passageways of the substrate become coated to the point that the diameter of the passageways in the coated portion is reduced to about 0.1 to about 5 microns in diameter. Thus, a dual porosity body is produced which has two, substantially different diameter layers. One layer contains passageways having diameters from 5 to 12 microns and another layer contains passageways having diameters of from about 0.1 to about 5 microns.

Coated substrates produced according to the present invention are well suited for use as electrodes in many types of electrochemical processes including electrolytic cells and fuel cells. They have been found to be particularly well suited for use as gas electrodes in chlor-alkali electrolytic cells. Use of dual porosity electrodes in electrolytic cells are described in U.S. Pat. Nos. 4,260,469 and 4,341,606, the teachings of which are hereby incorporated by reference.

EXAMPLE 1

A nickel substrate having a plurality of passageways traversing the member was supplied. The passageways had diameters of from about 8 to about 10 microns. The substrate was fitted into a frame so that one side could be kept dry by the application of slight gas pressure. This frame was placed in an electrolytic cell and the nickel substrate was made anodic for 5 minutes in a 60° C. bath containing 100 grams per liter sulfamic acid. The current was adjusted to about 120 milliamps/cm$^2$. This treatment activated the porous nickel on one side. The bath was then changed to one containing 300 grams per liter (g/l) nickel sulfamate, 6 g/l nickel chloride and 30 g/l boric acid. This plating solution was also maintained at 60° C. The nickel substrate was made cathodic and 85 milliamps/cm$^2$ of current was passed through the body for about 10 minutes. The diameter of the passageways contacting the electrodeposition solution were later tested by the bubble point method and were found to have been reduced to about 3 microns.

EXAMPLE 2

The coated substrate produced in Example 1 was used as an oxygen electrode in a chlor-alkali electrolytic cell. A saturated sodium chloride brine was fed into the cell containing an anode and a cathode. The cathode was the gas electrode prepared in Example 1. An oxygen-containing gas was fed to one side of the gas electrode and electrical energy at a voltage sufficient to cause electrolytic reactions to occur was passed between the anode and the cathode. Electrochemical reactions occurred at the anode producing chlorine and at the cathode producing sodium hydroxide.

What is claimed is:

1. A method for producing a dual porosity body from a substrate having a plurality of passageways traversing the substrate and connecting a first surface with a generally opposing second surface, said method comprising depositing a solid material onto the walls of at least a portion of the passageways adjoining only the first surface;

controlling the depth of penetration of the electrodeposition solution into the substrate by exposing one surface of the substrate to a pressurized gas; and stopping the deposition when the diameter of the passageways being coated has been reduced to a predetermined value, wherein the solid material is deposited by a method selected from the group consisting of electroplating and electroless plating from an electrodeposition solution.

2. The method of claim 1 including controlling the depth of penetration of the electrodeposition solution into the substrate by controlling the hydraulic pressure of the electrolyte and controlling the pressure of the gas.

3. A method for producing a dual porosity body from a substrate having a plurality of passageways traversing the substrate and connecting a first surface with a generally opposing second surface, said method comprising partially submerging the substrate in an electrodeposition solution;

depositing a solid material onto the walls of at least a portion of the passageways adjoining only the first surface; and stopping the deposition when the diameter of the passageways being coated has been reduced to a predetermined value, wherein the solid material is deposited by a method selected from the group consisting of electroplating and electroless plating.

4. The method of claim 1 wherein the solid material is electrically conductive.

5. The method of claim 1 wherein the solid material is selected from the group consisting of metals, metal alloys, ceramics and inorganic solids.

6. The method of claim 5 wherein the solid material is an electrocatalyst.

7. The method of claim 1 wherein the substrate is an electrically conductive material.

8. The method of claim 7 wherein the electrically conductive material is selected from the group consisting of steel, iron, nickel, copper, mixtures thereof and alloys thereof.

9. The method of claim 1 wherein the predetermined value is from about 0.1 to about 5 microns.

10. The method of claim 9 wherein the diameter of the uncoated passageways of the substrate are from about 5 to about 12 microns.

11. The method of claim 10 wherein the substrate has a thickness of from about 1 mm to about 3 mm.

12. The method of claim 11 wherein the solid material is deposited into passageways which are located within about 2 mm of the surface of the substrate.

13. The coated body produced according to the method of claim 1.

14. An electrochemical cell containing an anode and a cathode, wherein the cathode is the coated body of claim 13.

* * * * *